US005136860A

United States Patent [19]

Graf

[11] Patent Number: 5,136,860

[45] Date of Patent: Aug. 11, 1992

[54] CHAMBER FOR THE CONTINUOUS TREATMENT OF FILAMENTS

[75] Inventor: Felix Graf, Winterthur, Switzerland

[73] Assignee: Rieter Machine Works, Ltd., Winterthur, Switzerland

[21] Appl. No.: 619,025

[22] Filed: Nov. 28, 1990

[30] Foreign Application Priority Data

Dec. 14, 1989 [CH] Switzerland ..... 4496/89

[51] Int. Cl.[5] ..... D06B 3/06; D06B 23/18

[52] U.S. Cl. ..... 68/5 E; 28/219; 219/388; 249/117; 425/DIG. 44; 432/251

[58] Field of Search ..... 68/5 C, 5 D, 5 E, 6, 68/242, 181 R, 200; 432/247, 251; 219/388; 34/154, 155, 160; 100/93 P; 425/DIG. 44; 249/117; 28/219, 240, 249

[56] References Cited

U.S. PATENT DOCUMENTS

| | | | |
|---|---|---|---|
| 2,316,245 | 4/1943 | Hunter | 28/219 X |
| 2,688,067 | 8/1954 | Sonnino et al. | 28/219 X |
| 3,592,585 | 7/1971 | Candor et al. | 34/155 X |
| 4,471,637 | 9/1984 | Holzinger | 100/93 P X |
| 4,557,791 | 12/1985 | Fudickar et al. | 100/93 P X |
| 4,557,792 | 12/1985 | Yamada et al. | 100/93 P X |
| 4,763,495 | 8/1988 | Hayashi et al. | 68/242 X |
| 4,864,701 | 9/1989 | Goineau | 28/219 X |
| 5,046,225 | 9/1991 | Graf | 28/240 X |

FOREIGN PATENT DOCUMENTS

| | | | |
|---|---|---|---|
| 0184625 | 6/1986 | European Pat. Off. . | |
| 0249804 | 12/1987 | European Pat. Off. . | |
| 0256448 | 2/1988 | European Pat. Off. . | |
| 1060296 | 11/1953 | France | 100/93 P |
| 987722 | 3/1965 | United Kingdom | 34/160 |
| 2038893 | 7/1980 | United Kingdom . | |

*Primary Examiner*—Philip R. Coe
*Attorney, Agent, or Firm*—Kenyon & Kenyon

[57] ABSTRACT

In order to be able to operate chambers for the continuous fluid treatment of textile yarns and which comprise several chamber parts with an improved sealing effect, even at elevated pressures and temperatures when aggressive fluids are used, one or both sealing faces of superimposed sealing face pairs undergo shape correction. The shape correction opposes the elastic deformation undergone by the sealing faces when loaded under operating conditions.

7 Claims, 4 Drawing Sheets

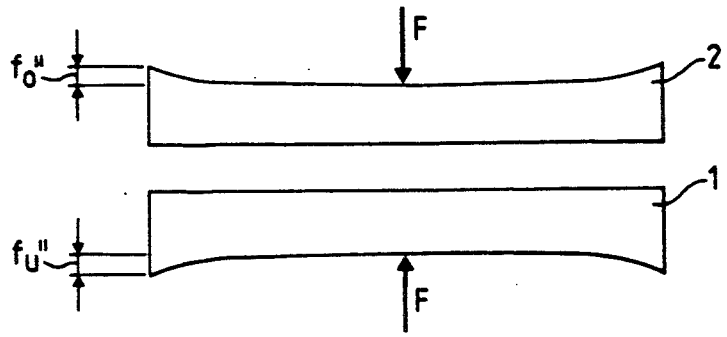
FIG. 3b
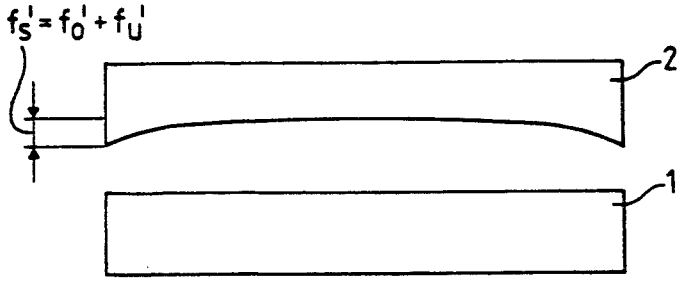
FIG. 4a
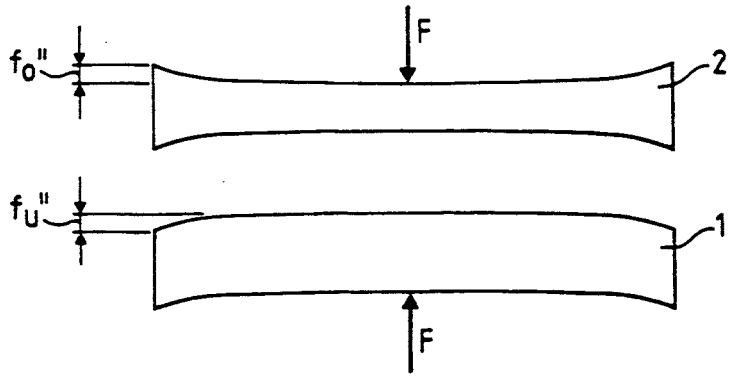
FIG. 4b
FIG. 5
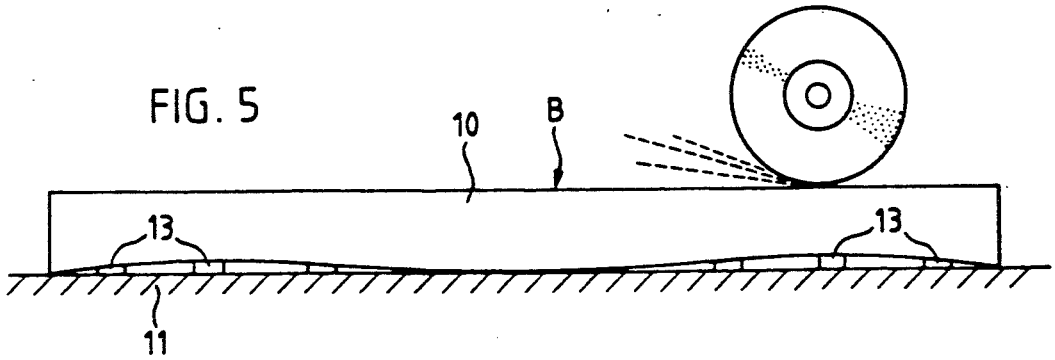

CHAMBER FOR THE CONTINUOUS TREATMENT OF FILAMENTS

The invention is in the field of textile technology and relates to a chamber for the continuous treatment of filaments.

For various different treatment processes for textile threads or yarns with fluids, such as e.g. air, steam or liquids, use is made of chambers through which the thread or yarn is continuously drawn and the fluid is circulated in the same or opposite direction to the yarn and in part at high temperatures. In such chambers the filaments are heated, braked, conveyed, stretched, dyed, layered, textured, vortexed, shrunk, relaxed, fixed, ultrasonically treated, etc. Synthetic yarns are e.g. drawn through a liquid chamber for stretching purposes. The liquid circulating in the same or opposite direction to the yarn in the chamber is used on the one hand for hydrodynamic braking and on the other as a heat exchanger, due to its high thermal capacity.

For inserting the yarns in the chamber and for both inspecting and cleaning the chamber, it is advantageous if the latter can be easily opened. Thus, the chambers are often made from two or more parts, which can be folded open or raised away from one another for opening purposes. For closing purposes they are again folded up or positioned upon one another and are pressed together with a minimum number of easily operable closing means, such as e.g. screws or clips. In the closed state the chamber parts must rest so tightly on one another that, apart from at the yarn inlet and outlet, no fluid can pass out and that there are no gaps in the interior of the chamber in which the yarns could become trapped and caught.

A stretching chamber for stretching filaments in a stretching bath is described in U.S. Pat. No. 5,046,225 and the chamber can be opened for the insertion of filament strips. It essentially comprises a base part and a cover part, the latter being constructable in such a way that also the bath length, i.e. the filament passage length in the bath liquid can be modified. The patent provides further details on divisible chambers for the stretching of filaments in a liquid bath.

As the demands regarding the geometrical accuracy of the inner areas of such chambers are very high and as frequently aggressive fluids circulate in the chambers at elevated temperatures, the sealing between the chamber parts by conventional elastic sealing materials leads to problems. Another reason for not using sealing materials is that the material must be very accurately positioned, which is only possible with increased effort and expenditure in the case of a sealing connection or joint, which has to be very frequently separated. Thus, in the interior of the chamber, the sealing medium must not project or leave any gap, because in both cases there would be a risk of filaments becoming caught.

The parts of such chambers can be provided with metallic sealing faces or sealing faces made from other hard materials. However, the processing or machining demands made on such sealing faces are very high and it is never possible to obtain a completely tight seal without adopting special measures with respect to the metallically sealed contact faces between the chamber parts. Therefore, means and ways for further improvements are sought.

The inadequacies with respect to the very high demands on the seal are due to the elastic deformation of the chamber parts and consequently also the sealing faces as a result of the forces exerted thereon in punctiform manner by the sealing means on the one hand and the forces of the medium acting in areal manner thereon on the other. Such deformations are particularly encountered with large sealing faces having a lightweight, i.e. not sufficiently rigid construction of the parts. However, it is not possible to avoid the use of large sealing faces, particularly in the case of chambers for high filament passage speeds and therefore longer construction, as well as in wide chambers for the treatment of several parallel yarns. A sufficiently rigid, i.e. therefore also very heavy construction for ensuring an absolute seal would lead to an undesirably high thermal inertia, excessive costs and more difficult handling. The application of so many closing means that they would ensure an absolute seal would make handling impossible. Therefore the bias up to now has been towards relatively untight chambers.

The problem of the present invention is to indicate the construction of chambers for the continuous fluid treatment of threads and yarns from individual chamber parts, in such a way that even in the case of a lightweight construction and without elastic sealing materials, i.e. solely with metallic sealing faces and only a few closing means, they are completely tight even in the case of constructions with large dimensions.

Briefly, the invention provides a chamber for the continuous treatment of filaments which is comprised of two rigid parts defining a chamber for treatment of a filament therein. At least one of these parts has an inlet for entry of a filament into the chamber and an outlet for exit of the filament from the chamber. In addition, the parts are movable between an open position with the parts separated from each other and a closed position with the parts in sealing contact with each other about the chamber. Still further, each part has a sealing face for sealing against the sealing face of the other of the parts in a closed position.

In accordance with the invention, at least one of the parts of the chamber has at least one section shaped relative to the other of the parts to permit deformation of the section relative to a remainder of the one part under a force applied to this remainder of the one part with the parts in the closed position in order to effect fluid-tight sealing of the parts together along the sealing faces thereof.

When the parts are in the closed position, the opposed sealing faces are pressed together in sealing contact. At the same time, the deformable section or sections of these parts are deformed under the force which is applied for sealing the parts together so as to maintain a fluid-tight sealing of the parts together.

As the set problem only relates to the sealing of the multipart chambers, the following description will mainly relate to the sealing faces of said chamber parts, i.e. other features of the chamber, such as e.g. the internal fitments are only diagrammatically indicated in the drawings and are not described in detail. Such details can be gathered from the aforementioned U.S. Pat. No. 5,046,225.

These and other objects and advantages of the invention will become more apparent from the following detailed description taken in conjunction with the accompany drawings wherein.

Figure 3A:
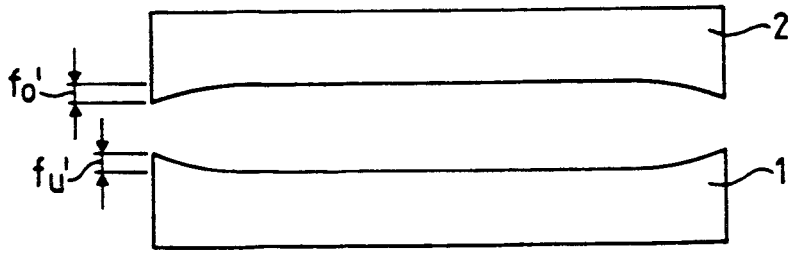
Figure 6:
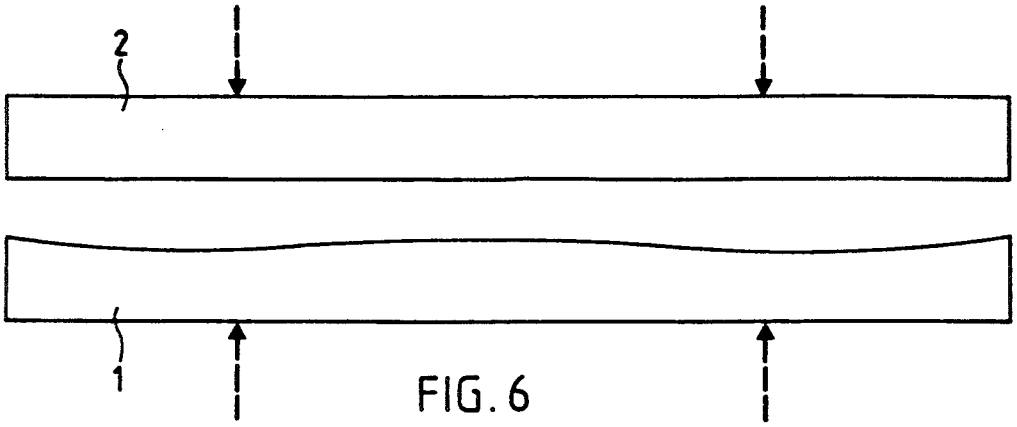
Figure 7A:
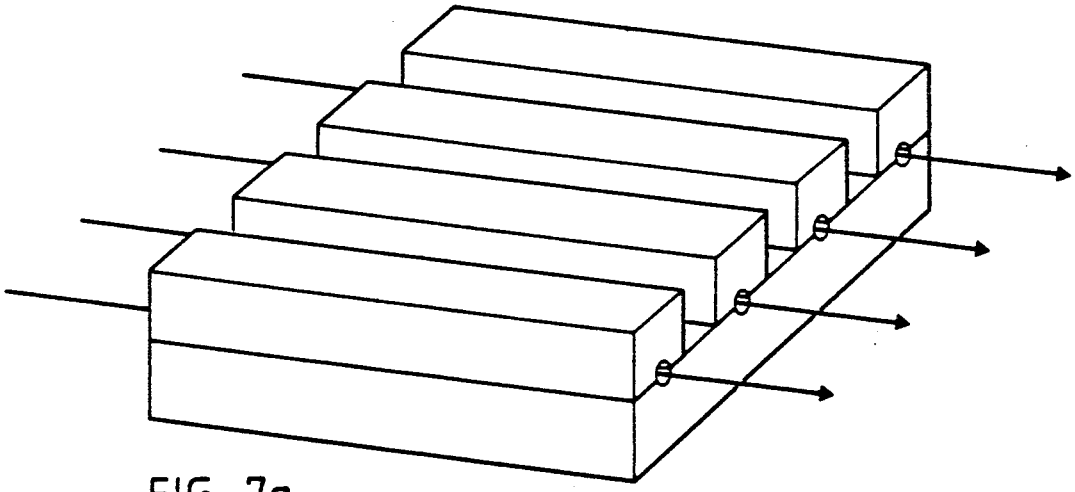
Figure 7B:
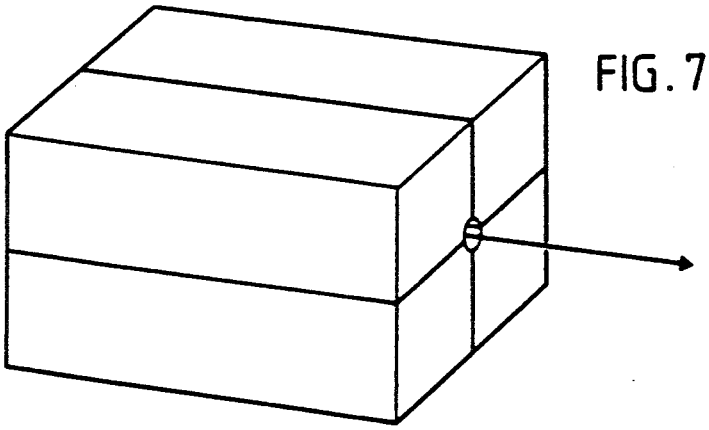
Figure 8A:
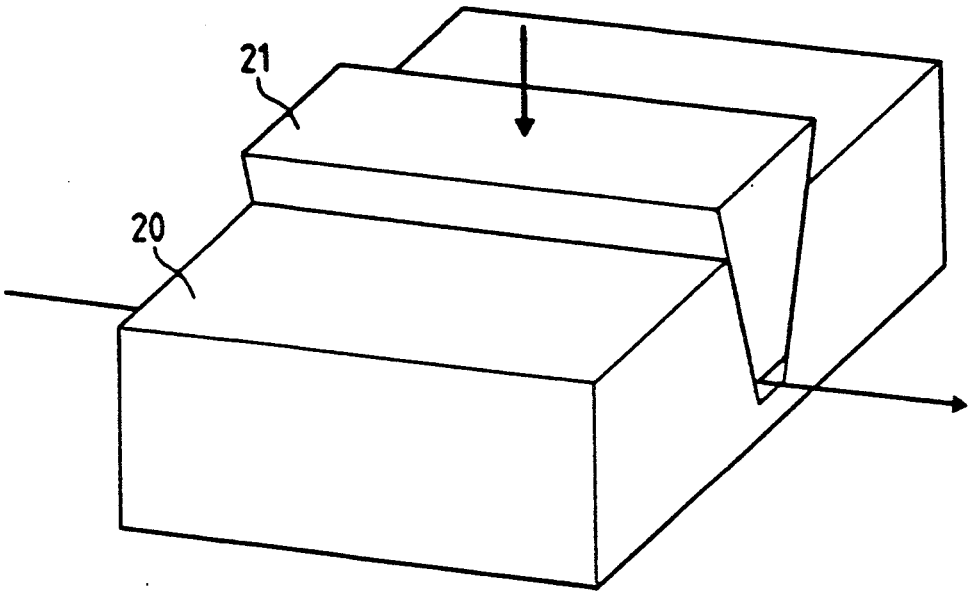
Figure 8B:
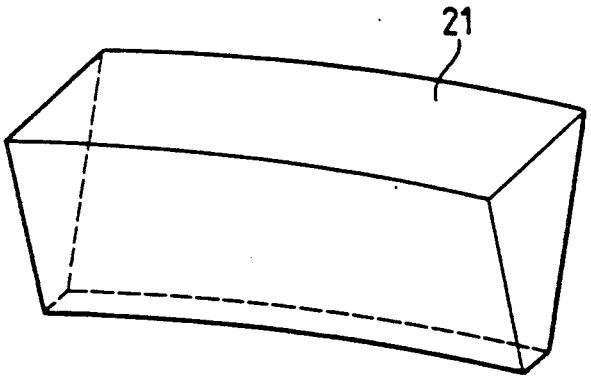

FIG. 3*a* illustrates a view of the chamber parts in an open condition with shaped sections capable of deforming under the forces applied during operation in accordance with the invention;

FIG. 3*b* schematically illustrates a longitudinal view of the chamber parts with the deformable sections in deformed condition under the forces applied during operation;

FIG. 4*a* illustrates an upper part of a chamber provided with shape correction in accordance with the invention;

FIG. 4*b* schematically illustrates the parts of a chamber of FIG. 4*a* during deformation in accordance with the invention;

FIG. 5 schematically illustrates a structure for shaping a chamber part to effect a shaped deformable section in accordance with the invention;

FIG. 6 illustrates the parts of a chamber having a lower part which is shaped to deform under the application of two closing forces in accordance with the invention;

FIG. 7*a* illustrates a perspective view of a treatment chamber having multiple passages in accordance with the invention;

FIG. 7*b* illustrates a chamber constructed in four parts in accordance with the invention;

FIG. 8 illustrates a perspective view of a modified chamber constructed in accordance with the invention with a wedge shaped top part; and FIG. 8*b* illustrates perspective view of a wedge-shaped part of the chamber of FIG. 8*a*.

The sealing principle of the inventive chambers is based on calculating the elastic deformation to be expected through the closing forces and the medium forces of the hard (not rubber-elastic) sealing faces, which can e.g. be metallic or ceramic and that the sealing faces are shape-corrected in such a way that they become planar due to deformation under the operating conditions and ensure an absolute seal. In order to cut down effort and costs during manufacture, the shape correction need only be performed on one of the two participating sealing faces, whereas the other is made planar. Both sealing faces are then so deformed under the operating conditions that a non-planar, but absolutely tight contact face is obtained.

Figure 1:
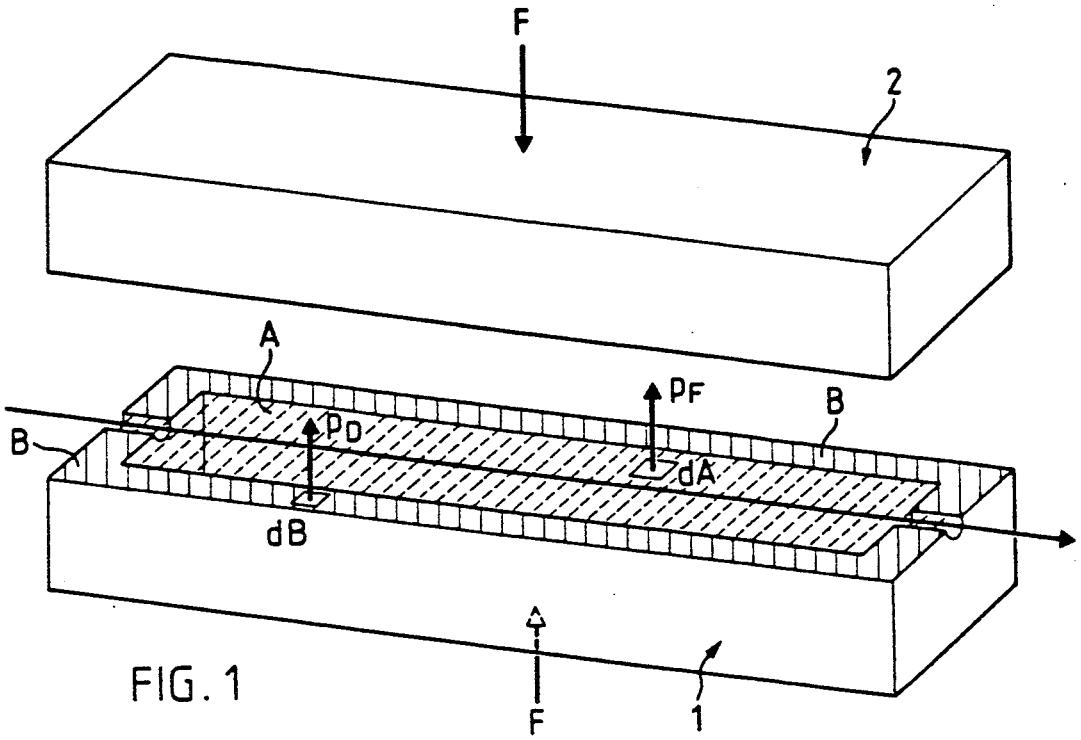
FIG. 1 is a diagrammatic view of a two-part chamber with forces acting on the individual faces.

FIG. 1 shows a simplified open chamber with a base 1 and a top 2 (for differently oriented chambers a bottom part 1 and a cover part 2). The two chamber parts 1, 2 are raised from one another and the thread passage is indicated by an arrow. The drawing also shows the forces acting on the chamber in operation. The two rigid parts define a chamber for a treatment of the thread or filament with at least one of the parts 1 having an inlet for entry of the filament in the chamber and an outlet for exit of the filament from the chamber. Further, the parts 1, 2 are movable between the illustrated open position with the parts separated from each other and a closed position (not shown) with the parts 1, 2 in sealing contact with each other about the chamber. The fluid pressure $p_F$ brought about by the fluid in the chamber acts on an inner face A of the chamber cavity and comprises a static and a dynamic component and is consequently dependent on the static pressure of the fluid and its velocity. A sealing pressure $p_D$ acts on the sealing faces B of the two parts 1, 2, respectively. In order to prevent the separation of the two parts and also fluid leaks. The sealing pressure is generally set somewhat higher than the fluid pressure. In order that the system of the two chamber parts 1, 2, respectively is under an equilibrium of forces, a closing force F must act on the chamber which corresponds to the sum of the forces on the faces of the parts, i.e.:

$$F=\int p_F dA+\int p_D dB$$

If the closing force F acts on a large surface of the chamber parts or if it is subdivided into a large number of components acting on regularly distributed points, the forces acting on the chamber parts will not deform them. However, if the closing force F only acts at one point on the parts, the latter are elastically deformed under the load. In the case of planar sealing faces, the elastic deformation leads to parts of the sealing faces closer to the application point of the closing force F, undergoing a higher sealing pressure $p_D$, whereas those positioned further away are subject to a lower or even no sealing pressure, which unavoidably leads to leaks. FIG. 1 shows the application point of the closing force in the center of the two chamber parts. This would correspond to a single closing means in the center of the chamber parts.

With the mathematical method of finite elements it is possible to calculate the deformation of a random sealing face to be expected. It is also possible to incorporate the effects of different thermal expansions of the participating parts into said calculation.

Figure 2:
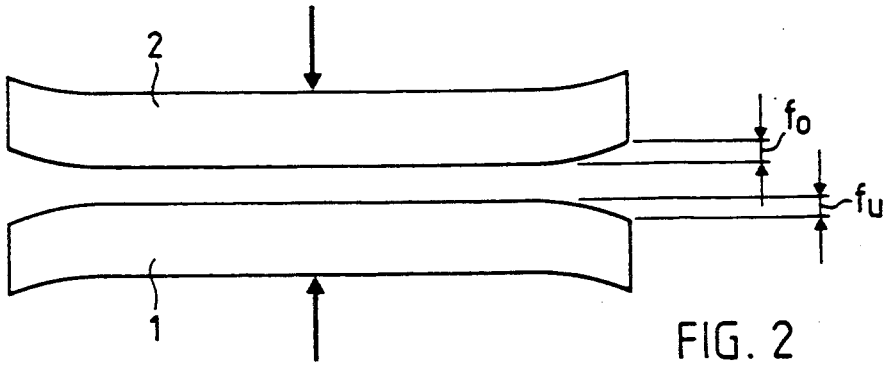
FIG. 2 illustrates a longitudinal sectional view through the chamber of FIG. 1 showing the expected deformations of the sealing faces produced by the forces which occur during operation.

FIG. 2 shows the expected deformation of the sealing faces of the chamber of FIG. 1 under operating conditions, i.e. under loading, along a longitudinal section. FIG. 2 shows the deformation of the chamber top $f_o$ and the deformation of the chamber base $f_u$, obviously in a highly overdimensioned manner. In reality, the deformations are a few hundredths of a millimetre. The calculation is based on the assumption that the fluid pressure over the chamber inner face and the sealing pressure are constant and that both chamber parts are identical. The same deformation is to be expected on both chamber parts if they have the same mechanical characteristics.

However, if now the sealing faces of the chamber parts undergo shape-correction ($f_o'$ and $f_u'$) as is diagrammatically indicated in FIG. 3*a*, then under operating conditions, the chamber parts will be deformed ($f_o''$ and $f_u''$) in such a way that the sealing faces are planar, cf. FIG. 3*b*.

As shown in FIG. 3*a*, the end section of each part 1, 2 is shaped relative to the other part in order to permit deformation of the section relative to the reaminder of the part under a force applied to the remainder of the part when the two-parts 1, 2 are in the closed position so as to effect a fluid-tight sealing of the parts 1, 2 together along the sealing faces thereof.

The shape correction can also be performed as a sum correction on a single chamber part, which is preferred due to the reduced effort and costs. FIG. 4*a* shows the necessary shape correction $f_s^1$ if only the upper part of the chamber in FIG. 1 is corrected and FIG. 4*b* the corresponding shape of the sealing faces in the laded state. If the two chamber parts are not identical, which would be the case in most practical circumstances, it is advantageous to correct the more elastic chamber part, because the hereinafter described correction process can be carried out with a smaller expenditure of force on the more elastic part.

However, in all cases, the shape correction will only represent a small fraction of the thickness of the chamber part, so that it can be brought about by grinding away the corresponding points, without modifying the mechanical characteristics of the chamber part. As shown in FIG. 5, to carry out the shape correction, the prepared chamber part 10 with the sealing face B remote from the plate is fixed to a magnetic or vacuum plate 11 and between the chamber part and the plate are placed intermediate layers 13 corresponding to the calculated deformation. In this elastically secured state, the sealing face is surface ground with a grinding tool. It must be borne in mind that under the tension of the chamber part only elastic securing takes place. If the chamber part is relieved and then loaded in accordance with the operating conditions, the sealing face becomes planar.

FIG. 6 shows a longitudinal section through the parts of a chamber pressed together by two closing means. The necessary shape correction, which is only performed on the chamber bottom, clearly reflects the two closing force components exerted by the two closing means.

FIGS. *7a* and *8b* show further variants of chambers, whose parts are pressed upon one another with shape-corrected, metallic sealing faces. FIG. *7a* shows a chamber for the treatment of four parallel yarns, which comprises a large base and four smaller top parts (one per yarn). The advantage of this variant is that the chambers of each individual yarn can be separately opened. FIG. *7b* shows a chamber constituted by four individual parts, which facilitates the manufacture of complicated interior space designs. Obviously a corresponding chamber can be constituted by two or more than four corresponding chamber parts.

Finally, FIG. *8a* shows an embodiment of the inventive chamber designed for very high fluid pressures and whereof one chamber part 20 is a block with a recess and in the represented case a V-shaped groove, whilst the other chamber part 21 has a shape corresponding to the recess and in the represented case is wedge-shaped. It is advantageous to carry out the shape correction in this case on the wedge-shaped closure part 21, so that it effectively has the shape shown in FIG. *8b*. Corresponding chambers for the passage of several yarns comprise a single chamber part with several recesses and several chamber parts fitting into the recesses.

I claim:

1. A chamber for the continuous treatment of filaments comprising at least two rigid parts defining a chamber for treatment of a filament therein, at least one part having an inlet for entry of a filament into said chamber and an outlet for exit of the filament from said chamber, said parts being movable between an open position with said parts separated from each other and a closed position with said parts in sealing contact with each other about said chamber;

each said part having a sealing face for sealing against the sealing face of the other of said parts in said closed position; and at least one of said parts having at least one section shaped relative to the other of said parts to permit deformation of said section relative to a remainder of said one part under a force applied to said remainder of said one part with said parts n said closed position to effect fluid-tight sealing of said parts together along said sealing faces thereof.

2. A chamber as set forth in claim 1 wherein said one part is a base part and said other part is a top part.

3. A chamber as set forth in claim 1 wherein each of said parts has at least one of said deformable sections.

4. A chamber as set forth in claim 1 wherein each of said parts is of rectangular shape and each part has a deformable section at each end thereof.

5. A chamber as set forth in claim 1 wherein said one part has a deformable section at each end thereof.

6. A chamber as set forth in claim 1 wherein said one part has a V-shaped groove and said second part is of wedge-shape and is received in said groove of said one part.

7. A chamber as set forth in claim 1 wherein each part has an entry for a filament and an exit for the filament whereby a filament passing therethrough is disposed in a plane of said sealing faces of said parts.

* * * * *

UNITED STATES PATENT AND TRADEMARK OFFICE

CERTIFICATE OF CORRECTION

PATENT NO. : 5,136,860

DATED : Aug. 11, 1992

INVENTOR(S) : FELIX GRAF

It is certified that error appears in the above-identified patent and that said Letters Patent is hereby corrected as shown below:

Column 4, line 1 change ". In" to -, in-
Line 64 change "laded" to -loaded-
Column 6, line 24, change, "n" to --in--

Signed and Sealed this

Fifth Day of October, 1993

Bruce Lehman

*Attest:*

BRUCE LEHMAN

*Attesting Officer*

*Commissioner of Patents and Trademarks*